US009390602B2

(12) United States Patent
Patterson et al.

(10) Patent No.: US 9,390,602 B2
(45) Date of Patent: Jul. 12, 2016

(54) SYSTEMS AND METHODS FOR VERIFICATION OF SECURITY TAG DETACHMENT

(71) Applicants: Hubert A. Patterson, Boca Raton, FL (US); Stewart E. Hall, Wellington, FL (US); Steve Maitin, Lake Worth, FL (US)

(72) Inventors: Hubert A. Patterson, Boca Raton, FL (US); Stewart E. Hall, Wellington, FL (US); Steve Maitin, Lake Worth, FL (US)

(73) Assignee: Tyco Fire & Security GmbH, Neuhausen AM Rheinfall (CH)

( * ) Notice: Subject to any disclaimer, the term of this patent is extended or adjusted under 35 U.S.C. 154(b) by 87 days.

(21) Appl. No.: 14/204,302

(22) Filed: Mar. 11, 2014

(65) Prior Publication Data

US 2014/0253333 A1 Sep. 11, 2014

Related U.S. Application Data

(60) Provisional application No. 61/775,936, filed on Mar. 11, 2013.

(51) Int. Cl.

| | |
|---|---|
| ***G08B 13/14*** | (2006.01) |
| ***G08B 13/24*** | (2006.01) |
| ***E05B 73/00*** | (2006.01) |

(52) U.S. Cl.

CPC ..... *G08B 13/2448* (2013.01); *E05B 73/0017* (2013.01); *E05B 73/0064* (2013.01); *G08B 13/246* (2013.01); *G08B 13/248* (2013.01); *G08B 13/2434* (2013.01); *G08B 13/2482* (2013.01)

(58) Field of Classification Search

CPC .... G08B 13/14; G08B 13/1427; G06K 19/07; G06K 19/0723

USPC ..... 340/572.4, 572.9, 572.7, 568.1

See application file for complete search history.

(56) References Cited

U.S. PATENT DOCUMENTS 4,553,136 A * 11/1985 Anderson, III .... G08B 13/2442 235/493

5,426,419 A 6/1995 Nguyen et al.

(Continued)

FOREIGN PATENT DOCUMENTS

AU 2012202003 A1 5/2012

WO 94 14143 A1 6/1994

(Continued)

*Primary Examiner* — Jack K Wang

(74) *Attorney, Agent, or Firm* — Fox Rothschild, LLP; Robert J. Sacco; Carol E. Thorstad-Forsyth

(57) ABSTRACT

Systems (100) and methods (1400) for verifying a detachment of a security tag (108) from an article. The methods comprise: producing by a detaching unit (106) a first signal at a first frequency and a second signal at a second frequency when the security tag is in proximity thereto; generating, by a non-linear electrical circuit (504) of the security tag, a third signal from the first and second signals applied thereto; ceasing generation of the third signal by the non-linear electrical circuit when at least a first portion (306) of the security tag is moved a certain distance from the detaching unit; and determining by the detaching unit that the first portion of the security tag has been decoupled from a second portion (318) of the security tag when the third signal is no longer being generated by the non-linear electrical circuit.

20 Claims, 10 Drawing Sheets

(56) References Cited

U.S. PATENT DOCUMENTS

| | | | | |
|---|---|---|---|---|
| 5,528,914 | A | 6/1996 | Nguyen et al. | |
| 5,535,606 | A | 7/1996 | Nguyen et al. | |
| 5,942,978 | A * | 8/1999 | Shafer | E05B 73/0017 340/10.5 |
| 5,955,951 | A * | 9/1999 | Wischerop | E05B 73/0017 340/10.42 |
| 6,121,878 | A * | 9/2000 | Brady | G06K 19/041 340/10.1 |
| 7,804,411 | B2 * | 9/2010 | Copeland | G06K 19/0726 340/568.1 |
| 7,973,661 | B2 | 7/2011 | Copeland | |
| 2006/0273902 | A1 * | 12/2006 | Shafer | G08B 13/2448 340/572.1 |
| 2007/0188333 | A1 | 8/2007 | Clancy et al. | |
| 2009/0224918 | A1 * | 9/2009 | Copeland | E05B 73/0017 340/572.1 |
| 2009/0309732 | A1 | 12/2009 | Truscott et al. | |
| 2010/0141452 | A1 | 6/2010 | Lian | |

FOREIGN PATENT DOCUMENTS

| | | | |
|---|---|---|---|
| WO | 2005 083655 | A2 | 9/2005 |
| WO | 2009020563 | A1 | 2/2009 |

* cited by examiner

SYSTEMS AND METHODS FOR VERIFICATION OF SECURITY TAG DETACHMENT

CROSS REFERENCE TO RELATED APPLICATIONS

This application claims the benefit of U.S. Provisional Patent Application Ser. No. 61/775,936 filed Mar. 11, 2013, which is herein incorporated by reference.

FIELD OF THE INVENTION

This document relates generally to security tag detachment systems. More particularly, this document relates to systems and methods for verifying the detachment of a security tag from a given article.

BACKGROUND OF THE INVENTION

Electronic Article Surveillance ("EAS") systems are often used by retail stores in order to minimize loss due to theft. One common way to minimize retail theft is to attach a security tag to an article such that an unauthorized removal of the article can be detected. In some scenarios, a visual or audible alarm is generated based on such detection. For example, a security tag with an EAS element (e.g., an acousto-magnetic element) can be attached to an article offered for sale by a retail store. An EAS interrogation signal is transmitted at the entrance and/or exit of the retail store. The EAS interrogation signal causes the EAS element of the security tag to produce a detectable response if an attempt is made to remove the article without first detaching the security tag therefrom. The security tag must be detached from the article upon purchase thereof in order to prevent the visual or audible alarm from being generated.

One type of EAS security tag can include a tag body which engages a tack. The tack usually includes a tack head and a sharpened pin extending from the tack head. In use, the pin is inserted through the article to be protected. The shank or lower part of the pin is then locked within a cooperating aperture formed through the housing of the tag body. In some scenarios, the tag body may contain a Radio Frequency Identification ("RFID") element or label. The RFID element can be interrogated by an RFID reader to obtain RFID data therefrom.

The EAS security tag may be removed or detached from the article using a detaching unit. Examples of such detaching units are disclosed in U.S. Pat. No. 5,426,419 ("the '419 patent), U.S. Pat. No. 5,528,914 ("the '914 patent"), U.S. Pat. No. 5,535,606 ("the '606 patent"), U.S. Pat. No. 5,942,978 ("the '978 patent") and U.S. Pat. No. 5,955,951 ("the '951 patent"). The detaching units disclosed in the listed patents are designed to operate upon a two-part hard EAS security tag. Such an EAS security tag comprises a pin and a molded plastic enclosure housing EAS marker elements. During operation, the pin is inserted through an article to be protected (e.g., a piece of clothing) and into an aperture formed through at least one sidewall of the molded plastic enclosure. The pin is securely coupled to the molded plastic enclosure via a clamp disposed therein. The pin is released by a detaching unit via a probe. The probe is normally retracted within the detaching unit. Upon actuation, the probe is caused to travel out of the detaching unit and into the enclosure of the EAS security tag so as to release the pin from the clamp or disengage the clamp from the pin. Once the pin is released from the clamp, the EAS security tag can be removed from the article.

While EAS security tags help reduce retail theft, improper use of the detaching unit is an ever growing problem that is inhibiting the effectiveness of the security tags. For example, an unscrupulous store employee may conspire to allow customers to steal merchandise by a practice known as "sweethearting ".“Sweethearting " involves collusion between the store employee and a customer. Typically, a cashier scans an inexpensive item for the customer to ring a sale and apparently complete the transaction. But then the cashier uses a detaching unit to remove the EAS security tag from a much more expensive item which was not scanned. The customer is then free to leave the premises with the expensive item without having paid therefore. In effect, "sweethearting " can cost businesses a relatively large amount of dollars each year.

There are various methods which attempt to prevent "sweethearting ". For example, a first method involves using a smart detaching unit. The smart detaching unit is communicatively coupled to a Point Of Sale ("POS") terminal and configured to read RFID data from the RFID element of the EAS security tag. In this case, a detachment process is completed only if purchase of the item can be verified through the POS data (e.g., by determining if an identifier read from the RFID element matches an identifier stored in a database). The verification is facilitated by a controlled Radio Frequency ("RF") field produced around the smart detaching unit. The RFID data can only be read when the EAS security tag is placed into the smart detaching unit. This approach is efficient and practical for mechanical detaching of the security tag from the item. However, the smart detaching unit does not allow the required amount of control for the antenna of the RFID reader thereof. Therefore, the RFID data of an EAS security tag, which is merely in proximity to the smart detaching unit rather than actually in the smart detacher unit, may be erroneously read by the RFID reader of the smart detaching unit.

A second method which attempts to prevent "sweethearting " requires a store employee to manually verify that the item having the EAS security tag detached therefrom is really being purchased. As should be understood, such manual verification may be unreliable if the store employee is unscrupulous.

A third method which attempts to prevent "sweethearting " does not involve verifying that the pin has been removed from the EAS security tag, i.e., actually detached from the article being purchased. Instead, the third method involves determining that the EAS security tag is in a certain area of the retail store.

SUMMARY OF THE INVENTION

The present invention concerns implementing systems and methods for verifying a detachment of a security tag from an article. The methods comprise producing by a detaching unit first and second signals when the security tag is in proximity thereto. The first signal has a first frequency and the second signal has a second frequency. In some scenarios, the first frequency falls within an Ultra-high frequency band and the second frequency falls within a low frequency band. Next, a non-linear electrical circuit of the security tag generates a third signal from the first and second signals applied thereto. In some scenarios, the non-linear electrical circuit includes, but is not limited to, a diode or a capacitor placed across two dipole antenna elements and/or a resonating capacitor of an antenna structure. The non-linear electrical circuit can be disposed in a pin head and/or a tag body of the security tag.

The generation of the third signal is ceased or terminated when at least a first portion of the security tag is moved a certain distance from the detaching unit. For example, if the non-linear electrical circuit is disposed in the pin head of the security tag, then it would stop generating the third signal when the pin is removed from the tag body and placed a certain distance from the tag body (which may still be in proximity to the detaching unit). When the third signal is no longer being generated by the non-linear electrical circuit, the detaching unit makes a determination that the first portion of the security tag (e.g., the pin) has been decoupled from a second portion of the security tag (e.g., the tag body).

Prior to or subsequent to such a determination by the detaching unit, the validity of information obtained from the security tag is verified. For example, a unique identifier for the security tag is compared to a list of identifiers to determine if a match exists therebetween. The unique identifier can be obtained by the detaching unit via RFID communications with an RFID element of the security tag.

A purchase transaction of the article may be completed when the validity of the information has been verified. In some cases, the purchase transaction is not completed until after the above described determination has also been made by the detaching unit (i.e., the determination that the first portion of the security tag has been decoupled from the second portion of the security tag).

DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
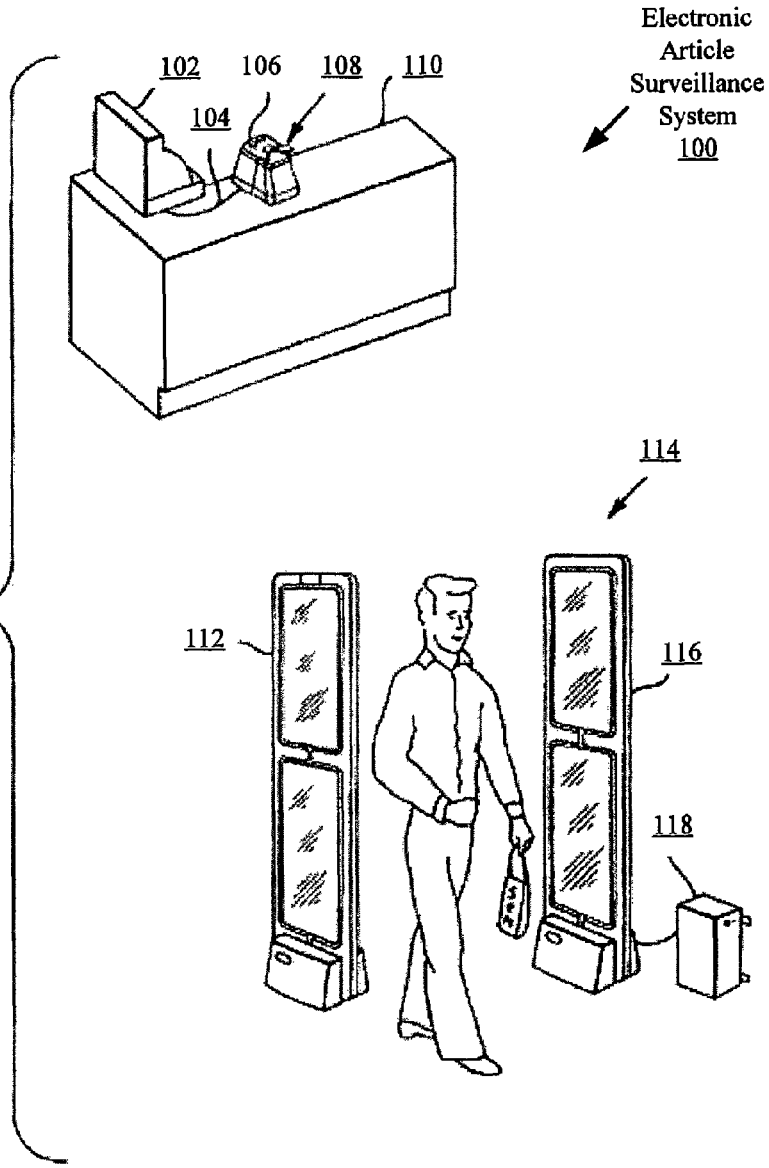
FIG. 1 is a schematic illustration of an exemplary architecture for an EAS system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Embodiments will now be described with respect to FIGS. 1-12. Embodiments generally relate to novel systems and methods for verifying a detachment of a security tag from an article. The methods comprise producing by a detaching unit first and second signals when the security tag is in proximity thereto. The first signal has a first frequency and the second signal has a second frequency different from the first frequency. In some scenarios, the first signal is an RF signal and the second signal is an electrostatic signal. Next, a non-linear electrical circuit of the security tag generates a third signal from the first and second signals applied thereto. In some scenarios, the non-linear electrical circuit includes, but is not limited to, a diode or a capacitor placed across two dipole antenna elements and/or a resonating capacitor of an antenna structure. The generation of the third signal is ceased or terminated when at least a first portion of the security tag is moved a certain distance from the detaching unit. For example, if the non-linear electrical circuit is disposed in a pin head of the security tag, then it would stop generating the third signal when the pin is removed from the tag body and placed a certain distance from the tag body (which is still in proximity to the detaching unit). When the third signal is no longer being generated by the non-linear electrical circuit, the detaching unit makes a determination that the first portion of the security tag has been decoupled from a second portion of the security tag.

Referring now to FIG. 1, there is provided a schematic illustration of an exemplary EAS system 100 that is useful for understanding the present invention. EAS systems are well known in the art, and therefore will not be described in detail herein. Still, it should be understood that the present invention will be described herein in relation to an acousto-magnetic (or magnetostrictive) EAS system. Embodiments of the present invention are not limited in this regard. The EAS system 100 may alternatively include a magnetic EAS system, an RF EAS system, a microwave EAS system or other type of EAS system. In all cases, the EAS system 100 generally prevents the unauthorized removal of articles from a retail store, as well as the verification that pins have been removed from respective tag bodies of EAS security tags when removal of the corresponding articles from a retail store is authorized.

In this regard, EAS security tags 108 are securely coupled to articles (e.g., clothing, toys, and other merchandise) offered for sale by the retail store. Exemplary embodiments of the EAS security tags 108 will be described below in relation to FIGS. 3-12. At the exits of the retail store, detection equipment 114 sounds an alarm or otherwise alerts store employees when it senses an active EAS security tag 108 in proximity thereto. Such an alarm or alert provide notification to store employees of an attempt to remove an article from the retail store without proper authorization.

In some scenarios, the detection equipment 114 comprises antenna pedestals 112, 116 and an electronic unit 118. The antenna pedestals 112, 116 are configured to create a surveillance zone at the exit or checkout lane of the retail store by transmitting an EAS interrogation signal. The EAS interrogation signal causes an active EAS security tag 108 to produce a detectable response if an attempt is made to remove the article from the retail store. For example, the EAS security tag 108 can cause perturbations in the interrogation signal, as will be described in detail below.

The antenna pedestals 112, 116 may also be configured to act as RFID readers. In these scenarios, the antenna pedestals 112, 116 transmit an RFID interrogation signal for purposes of obtaining RFID data from the active EAS security tag 108. The RFID data can include, but is not limited to, a unique identifier for the active EAS security tag 108. In other scenarios, these RFID functions are provided by devices separate and apart from the antenna pedestals.

The EAS security tag 108 can be deactivated and detached from the article using a detaching unit 106. Typically, the EAS security tag 108 is removed or detached from the articles by store employees when the corresponding article has been purchased or has been otherwise authorized for removal from the retail store. The detaching unit 106 is located at a checkout counter 110 of the retail store and communicatively coupled to a POS terminal 102 via a wired link 104. In general, the POS terminal 102 facilitates the purchase of articles from the retail store.

Detaching units and POS terminals are well known in the art, and therefore will not be described herein. The POS terminal 102 can include any known or to be known POS terminal with or without any modifications thereto. However, the detaching unit 106 includes any known or to be known detaching unit selected in accordance with a particular application which has some hardware and/or software modifications made thereto so as to facilitate the implementation of the present invention (which will become more evident below).

In some cases, the detaching unit 106 is configured to operate as an RFID reader. As such, the detaching unit 106 may transmit an RFID interrogation signal for purposes of obtaining RFID data from an EAS security tag. Upon receipt of the unique identifier, the detaching unit 106 communicates the unique identifier to the POS terminal 102. At the POS terminal 102, a determination is made as to whether the unique identifier is a valid unique identifier for an EAS security tag of the retail store. If it is determined that the unique identifier is a valid unique identifier for an EAS security tag of the retail store, then the POS terminal 102 notifies the detaching unit 106 that the unique identifier has been validated, and therefore the EAS security tag 108 can be removed from the article.

Figure 2:
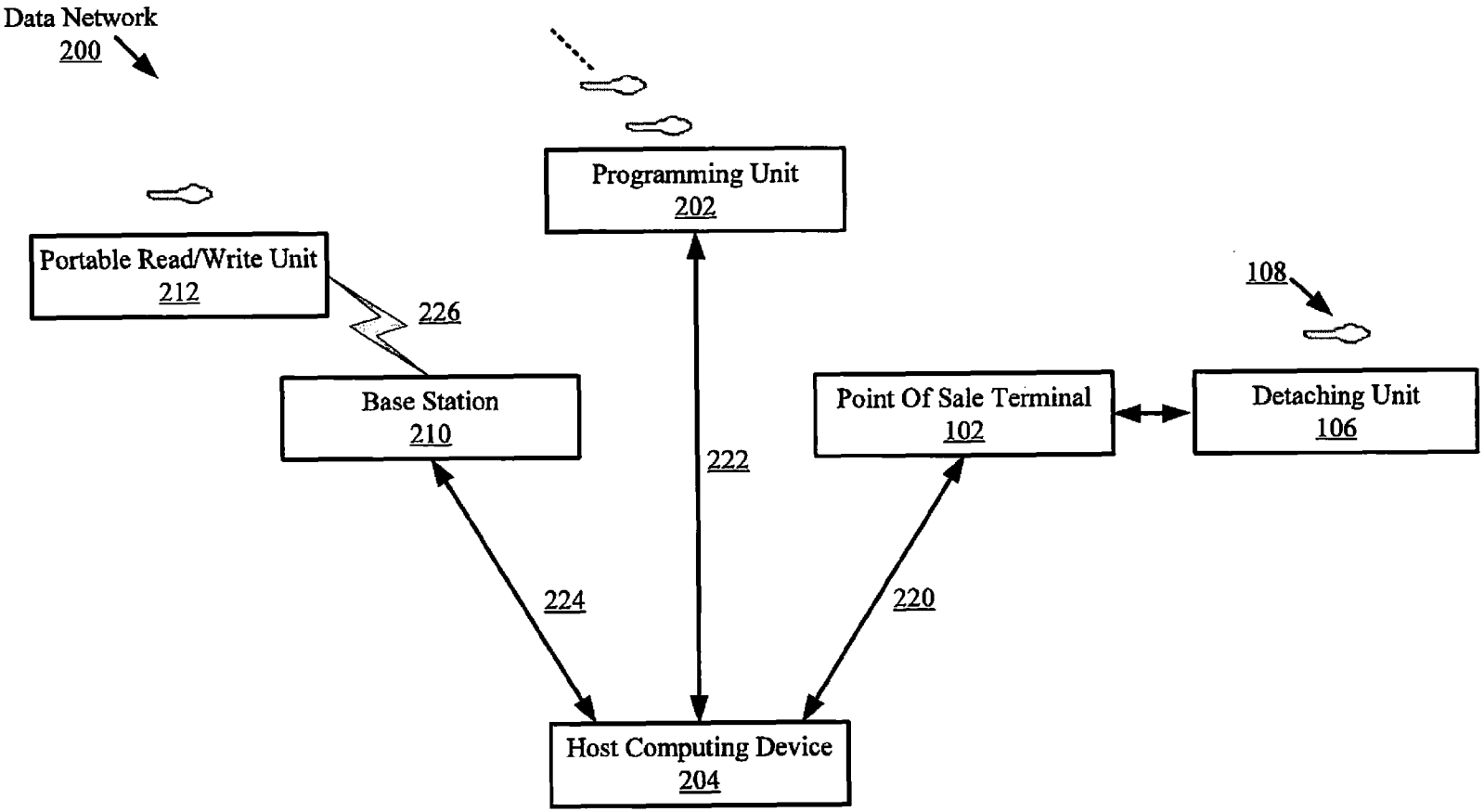
FIG. 2 is a schematic illustration of an exemplary architecture for a data network that is useful for understanding the present invention.

Referring now to FIG. 2, there is provided a schematic illustration of an exemplary architecture for a data network 200 in which the various components of the EAS system 100 are coupled together. Data network 200 comprises a host computing device 204 which stores data concerning at least one of merchandise identification, inventory, and pricing. A first data signal path 220 allows for two-way data communication between the host computing device 204 and the POS terminal 102. A second data signal path 222 permits data communication between the host computing device 204 and a programming unit 202. The programming unit 202 is generally configured to write product identifying data and other information into memory of the EAS security tag 108. A third data signal path 224 permits data communication between the host computing device 204 and a base station 210. The base station 210 is in wireless communication with a portable read/write unit 212. The portable read/write unit 212 reads data from the EAS security tags for purposes of determining the inventory of the retail store, as well as writes data to the EAS security tags. Data can be written to the EAS security tags when they are applied to articles of merchandise.

Figure 3:
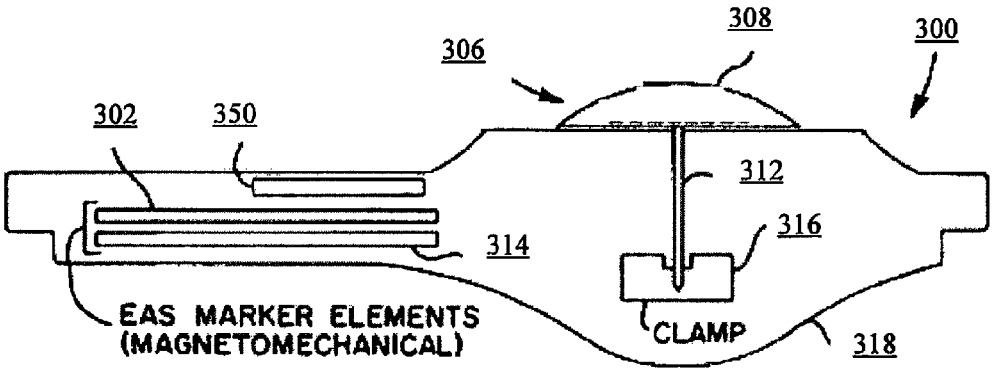
FIG. 3 is a cross sectional view of a first exemplary architecture for an EAS security tag shown that is useful for understanding the present invention.

Referring now to FIG. 3, there is provided a cross sectional view of an exemplary architecture for an EAS security tag 300. EAS security tag 108 can be the same as or similar the EAS security tag 300. As such, the discussion of EAS security tag 300 is sufficient to understand EAS security tag 108 of FIGS. 1-2.

As shown in FIG. 3, EAS security tag 300 comprises a housing 318 which is at least partially hollow. The housing 318 can be formed from a rigid or semi-rigid material, such as plastic. A pin 306 is removably coupled to the housing 318. The pin 306 comprises a head 308 and a shaft 312. The shaft 312 is inserted into a recessed hole formed in the housing 318. The shaft 312 is held in position within the recessed hole via a clamping mechanism 316, which is mounted inside the housing 318.

A magnetostrictive active EAS element 314 and a bias magnet 302 are also disposed within the housing 318. These components 314, 302 may be the same as or similar to that disclosed in U.S. Pat. No. 4,510,489. In some scenarios, the resonant frequency of components 314, 302 is the same as the frequency at which the EAS system (e.g., EAS system 100 of FIG. 1) operates (e.g., 58 kHz). Additionally, the EAS element 314 is formed from thin, ribbon-shaped strips of substantially completely amorphous metal-metalloid alloy. The bias magnet 302 is formed from a rigid or semi-rigid ferromagnetic material. Embodiments are not limited to the particulars of these scenarios.

During operation, antenna pedestals (e.g., antenna pedestals 112, 116 of FIG. 1) of an EAS system (e.g., EAS system 100 of FIG. 1) emit periodic tonal bursts at a particular frequency (e.g., 58 kHz) that is the same as the resonance frequency of the amorphous strips (i.e., the EAS interrogation signal). This causes the strips to vibrate longitudinally by magnetostriction, and to continue to oscillate after the burst is over. The vibration causes a change in magnetism in the amorphous strips, which induces an AC voltage in an antenna structure (not shown in FIG. 3). The antenna structure (not shown in FIG. 3) converts the AC voltage into a radio wave. If the radio wave meets the required parameters (correct frequency, repetition, etc.), the alarm is activated.

A verification element 350 is also provided within the housing 318. The verification element 350 is generally configured to facilitate a determination as to whether the pin 306 is removed from the housing 318 during a POS transaction or other transaction in which removal of the EAS security tag from an article is authorized. In this regard, the verification element 350 is configured to act as a frequency mixer. Therefore, during the transaction, a detaching unit (e.g., detaching unit 106 of FIGS. 1-2) produces an RF field and an electrostatic field. These fields can be continuously produced by the detaching unit, or only when the security tag is in proximity to the detaching unit. In the later scenario, the detaching unit may comprise one or more proximity sensors (not shown) to detect when a security tag is in proximity thereto. The proximity sensors can include, but are not limited, to RFID enabled devices and/or depressible switches. In response to such detection, the detaching unit generates the RF field and electrostatic field.

In all scenarios, the RF field produced by the detaching unit is at a first frequency (e.g., 900 MHz). The electrostatic field is at a second frequency (e.g., 100 kHz). The first and second frequencies may be different from each other. For example, the first frequency may fall within the Ultra-high frequency band (e.g., 300 MHz-3 GHz), and the second frequency may fall within a different frequency band, such as the low RF frequency band (e.g., 30 kHz-300 kHz). An antenna structure (not shown in FIG. 3) of the verification element 350 is resonant at the first frequency (e.g., 900 MHz). If a non-linear element is placed across dipole antenna elements of the antenna structure, then the electrostatic field modulates the capacitance of the non-linear element. In effect, the non-linear element creates at least one response signal from mixing two signals applied thereto. Reception of the response signal by the detaching unit indicates that the pin 306 is still coupled to the housing 318.

Figure 4:
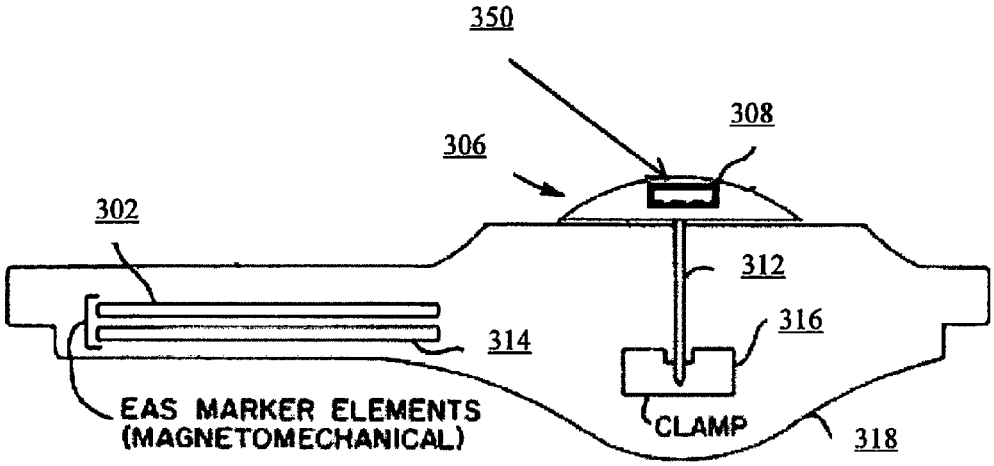
FIG. 4 is a cross sectional view of a second exemplary architecture for an EAS security tag that is useful for understanding the present invention.

Notably, the present invention is not limited to the architecture of EAS security tag 300 shown in FIG. 3. For example, in other scenarios, the EAS security element 350 may alternatively be disposed within the head 308 of the pin 306, as shown in FIG. 4.

Figure 5:
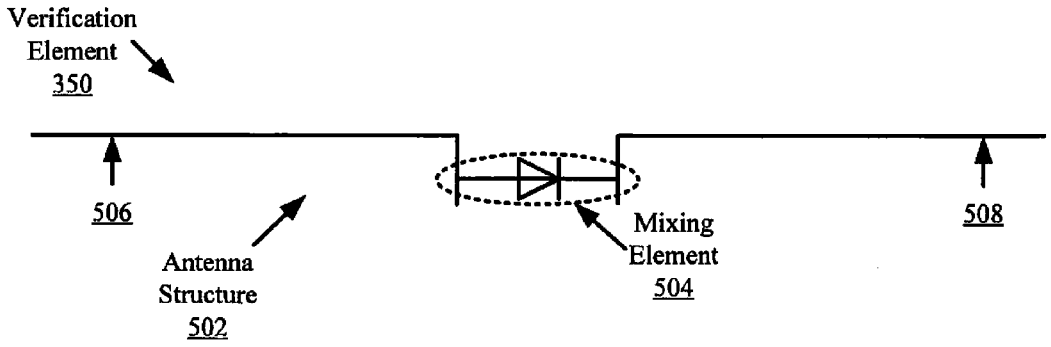
FIG. 5 is a schematic illustration of a first exemplary architecture for a security element of an EAS security tag that is useful for understanding the present invention.

Referring now to FIG. 5, there is provided a schematic illustration of an exemplary architecture for the verification element 350. The verification element 350 comprises an antenna structure 502 and a mixing element 504. The antenna structure 502 comprises dipole antenna elements 506, 508 collectively configured to operate at any desired frequency (e.g., 13.56 MHz or 915 MHz), which may be dependent on local government regulations.

The mixing element 504 is generally provided for allowing a detaching unit (e.g., detaching unit 106 of FIG. 1) to determine whether or not the pin 306 has been removed from the housing 318 of the EAS security tag 300. In this regard, the mixing element 504 comprises a non-linear element. The non-linear element 404 includes, but is not limited to, a diode as shown in FIG. 5 or a Metal-Oxide Semiconductor ("MOS") capacitor (not shown). During operation, the mixing element 504 responds to an RF field and an electrostatic field generated by a detaching unit (e.g., detaching unit 106 of FIG. 1), as described above. Briefly, the mixing element 504 generates at least one response signal from mixing the RF signal and the electrostatic signal applied thereto. Reception of the response signal by the detaching unit indicates that a pin is still coupled to a housing of an EAS security tag.

Figure 6:
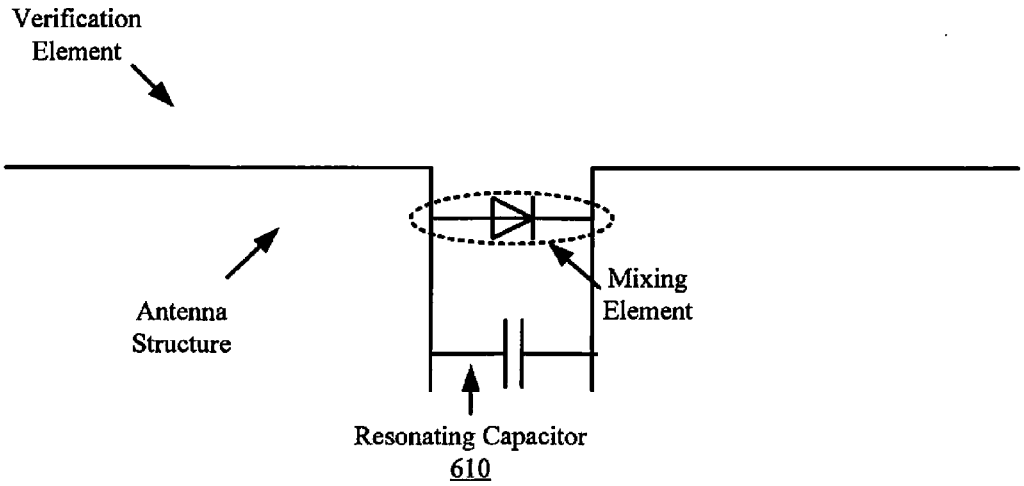
FIG. 6 is a schematic illustration of a second exemplary architecture for a security element of an EAS security tag that is useful for understanding the present invention.

Embodiments of the present invention are not limited to the verification element architecture shown in FIG. 5. For example, the antenna structure may additionally comprise a resonating capacitor 610, as shown in FIG. 6. In this case, the mixing element may be placed across or arranged in parallel with the resonating capacitor 610.

Figure 7:
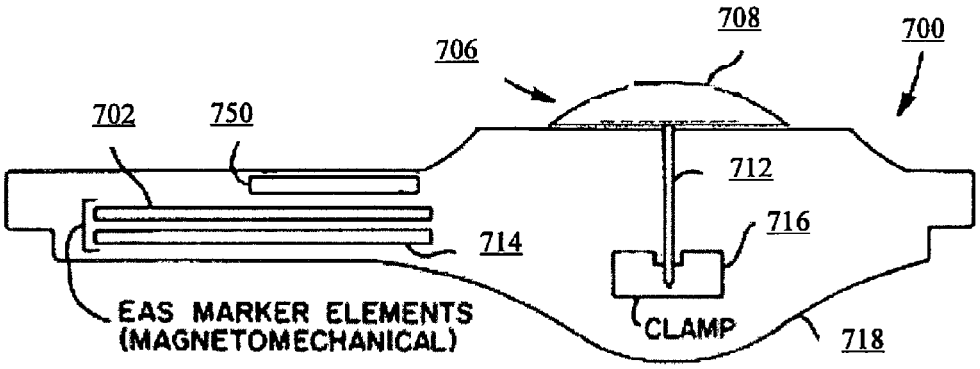
FIG. 7 is a cross sectional view of a third exemplary architecture for an EAS security tag that is useful for understanding the present invention.

As noted above, the EAS security tag may also comprise an RFID element. An exemplary architecture for an EAS security tag 700 with such an RFID element is schematically illustrated in FIG. 7. EAS security tag 108 of FIGS. 1-2 may be the same as or similar to EAS security tag 700. As such, the following discussion of EAS security tag 700 is sufficient for understanding EAS security tag 108 of FIGS. 1-2.

As shown in FIG. 7, the EAS security tag 700 comprises a housing 718 which is at least partially hollow. The housing 718 can be formed from a rigid or semi-rigid material, such as plastic. A pin 706 is removably coupled to the housing 718. The pin 706 comprises a head 708 and a shaft 712. The shaft 712 is inserted into a recessed hole formed in the housing 718. The shaft 712 is held in position within the recessed hole via a clamping mechanism 716, which is mounted inside the housing 718.

A magnetostrictive active EAS element 714 and a bias magnet 702 are also disposed within the housing 718. These components 714, 702 may be the same as or similar to that disclosed in U.S. Pat. No. 4,510,489. In some scenarios, the resonant frequency of components 714, 702 is the same as the frequency at which the EAS system (e.g., EAS system 100 of FIG. 1) operates (e.g., 58 kHz). Additionally, the EAS element 714 is formed from thin, ribbon-shaped strips of substantially completely amorphous metal-metalloid alloy. The bias magnet 702 is formed from a rigid or semi-rigid ferromagnetic material. Embodiments are not limited to the particulars of these scenarios.

During operation, antenna pedestals (e.g., antenna pedestals 112, 116 of FIG. 1) of an EAS system (e.g., EAS system 100 of FIG. 1) emit periodic tonal bursts at a particular frequency (e.g., 58 kHz) that is the same as the resonance frequency of the amorphous strips (i.e., the EAS interrogation signal). This causes the strips to vibrate longitudinally by magnetostriction, and to continue to oscillate after the burst is over. The vibration causes a change in magnetism in the amorphous strips, which induces an AC voltage in an antenna structure (not shown in FIG. 3). The antenna structure (not shown in FIG. 3) converts the AC voltage into a radio wave. If the radio wave meets the required parameters (correct frequency, repetition, etc.), the alarm is activated.

A hybrid verification element 750 is also provided within the housing 718. The hybrid verification element 750 is generally configured to: (1) validate RFID data stored on the hybrid verification element 750; and (2) facilitate a determination as to whether the pin 706 is removed from the housing 718 during a POS transaction or other transaction in which removal of the EAS security tag from an article is authorized.

With regard to function (1), the hybrid verification element 750 is configured to respond to an RFID interrogation signal. For example, in response to the reception of an RFID interrogation signal, the hybrid verification element 750 transmits the RFID data to the source of the RFID interrogation signal, such as the detaching unit 106 of FIGS. 1-2. Upon receipt of the RFID data, the source communicates the same to a POS terminal (e.g., POS terminal 102 of FIG. 1). At the POS terminal, a determination is made as to whether the RFID data is a valid for an EAS security tag of the retail store. If it is determined that the RFID data is valid RFID data for an EAS security tag of the retail store, then the POS terminal notifies the source that the RFID data has been validated, and therefore the EAS security tag 108 can be removed from the article.

With regard to function (2), the hybrid verification element 750 is configured to act as a frequency mixer. In this regard, the hybrid verification element 750 acts similar to or the same as the verification element 350 described above. Accordingly, a non-linear element of the hybrid verification element 750 creates at least one response signal from mixing an RF signal and an electrostatic signal applied thereto. Reception of the response signal by the detaching unit indicates that the pin 706 is still coupled to the housing 718.

Figure 8:
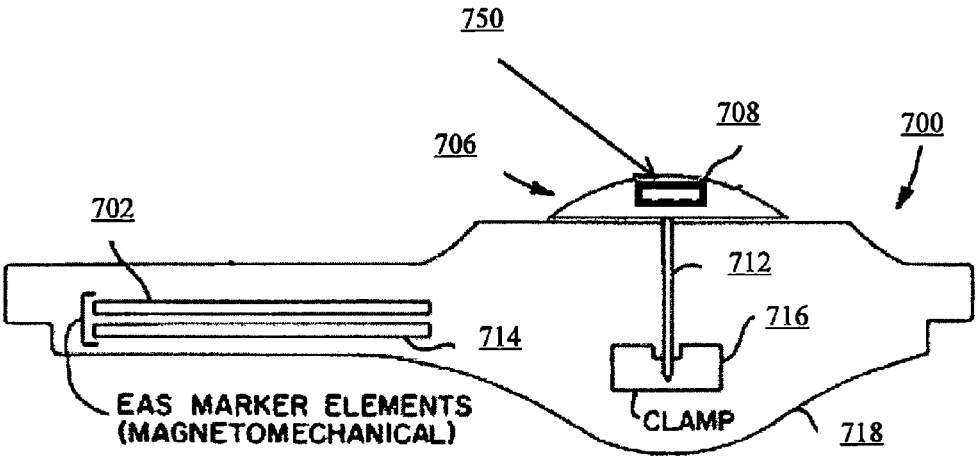
FIG. 8 is a cross sectional view of a fourth exemplary architecture for an EAS security tag that is useful for understanding the present invention.
Figure 11:
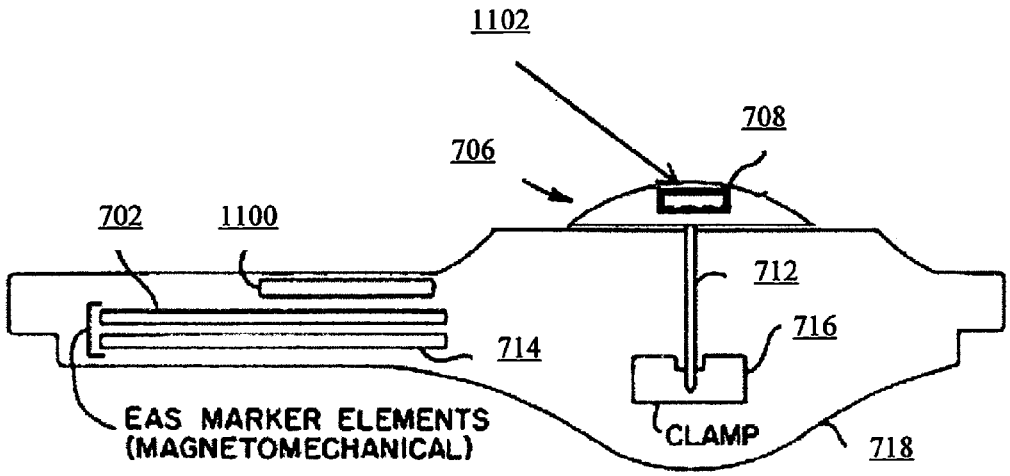
FIG. 11 is a cross sectional view of a fifth exemplary architecture for an EAS security tag that is useful for understanding the present invention.

Notably, the present invention is not limited to the architecture of EAS security tag 700 shown in FIG. 7. For example, in other scenarios, the hybrid verification element 750 may alternatively be disposed within the head 708 of the pin 706, as shown in FIG. 8. Alternatively, an RFID portion 1100 of the hybrid verification element can be disposed in the housing 718 of the EAS security tag and a mixing portion 1102 of the hybrid verification element can be disposed in the head 708 of the pin 706 (or vice versa), as shown in FIG. 11.

Figure 9:
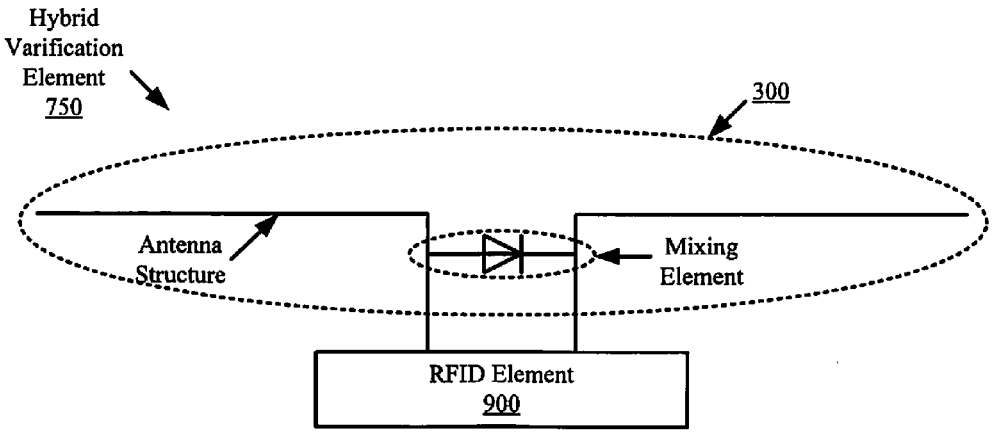
FIG. 9 is a schematic illustration of a first exemplary architecture for a hybrid security element of an EAS security tag that is useful for understanding the present invention.
Figure 10:
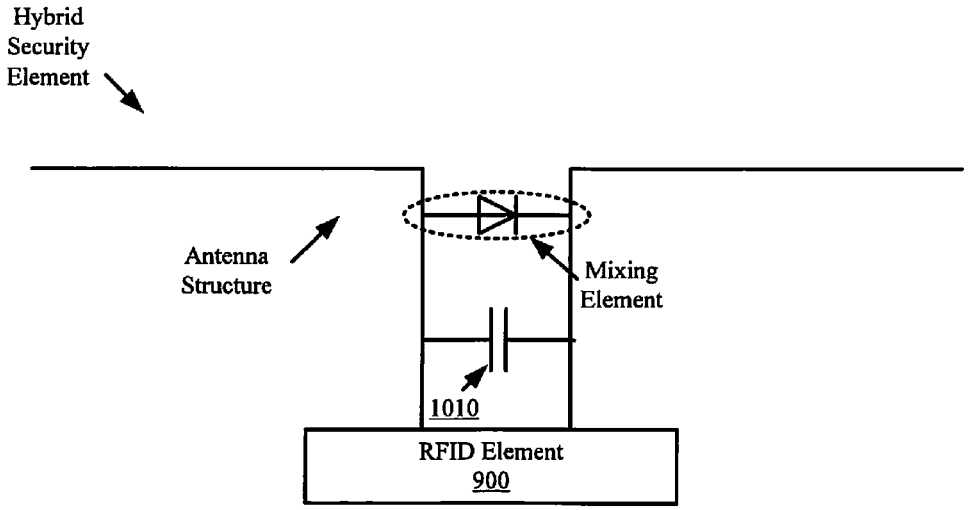
FIG. 10 is a schematic illustration of a second exemplary architecture for a hybrid security element of an EAS security tag that is useful for understanding the present invention.

Referring now to FIG. 9, there is provided a schematic illustration of an exemplary architecture for the hybrid verification element 750. The hybrid verification element 750 comprises the verification element 300 of FIG. 3 and an RFID element 900. As described above, the verification element 300 comprises a mixing element. The mixing element is disposed across or arranged in parallel with the RFID element 900. Embodiments of the present invention are not limited to the hybrid verification element architecture shown in FIG. 9. For example, the antenna structure may additionally comprise a resonating capacitor 1010, as shown in FIG. 10. In this case, the mixing element may be placed across or arranged in parallel with the resonating capacitor 1010.

The RFID element 900 is configured to act as a transponder in connection with the article identification aspects of the EAS system (e.g., EAS system 100 of FIG. 1). In this regard, the RFID element 900 stores multi-bit identification data and emits an identification signal corresponding to the stored multi-bit identification data. The identification signal is emitted in response to the reception of the RFID interrogation signal (e.g., the RFID interrogation signal transmitted from the antenna pedestals 112, 116 and/or the detaching unit 106 of FIG. 1). In some scenarios, the transponder circuit of the RFID element 900 is the model 210 transponder circuit available from Gemplus, Z. I. Athelia III, Voie Antiope, 13705 La Ciotat Cedex, France. The model 210 transponder circuit is a passive transponder which operates at 13 MHz and has a considerable data storage capability.

Figure 12:
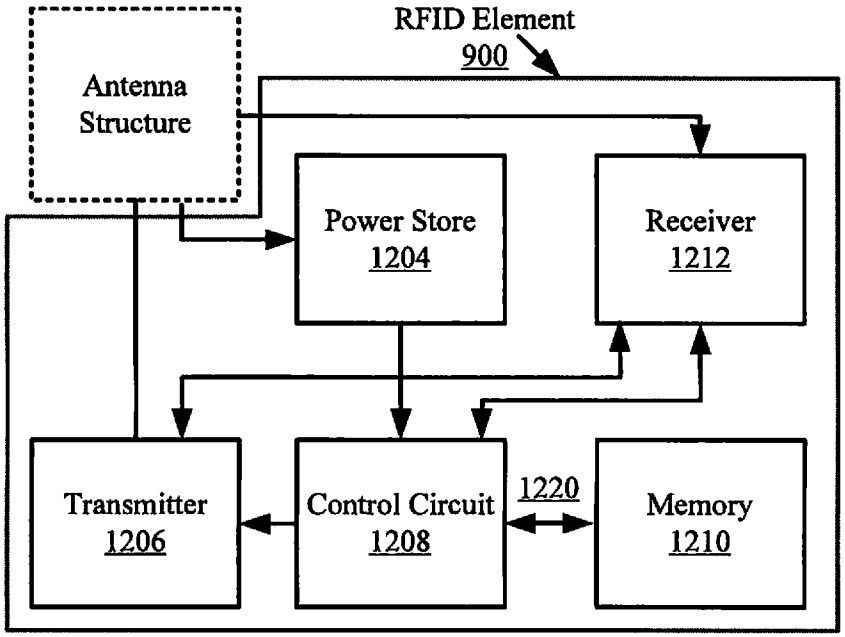
FIG. 12 is a block diagram of an exemplary hardware architecture for a hybrid security element that is useful for understanding the present invention.

Referring now to FIG. 12, there is provided a block diagram of an exemplary architecture for the RFID element 900. The RFID element 900 may include more or less components than those shown in FIG. 12. However, the components shown are sufficient to disclose an illustrative embodiment implementing the present invention. Some or all of the components of the RFID element 900 can be implemented in hardware, software and/or a combination of hardware and software. The hardware includes, but is not limited to, one or more electronic circuits. The hardware includes, but is not limited to, one or more electronic circuits. The electronic circuits can include, but are not limited to, passive components (e.g., resistors and capacitors) and/or active components (e.g., amplifiers and/or microprocessors). The passive and/or active components can be adapted to, arranged to and/or programmed to perform one or more of the methodologies, procedures, or functions described herein.

The RFID element 900 comprises a power store 1204, a transmitter 1206, a control circuit 1208, memory 1210 and a receiver 1212. Notably, components 1204, 1206 and 1212 are coupled to an antenna structure when implemented in the hybrid verification element 750. As such, an antenna structure is shown in FIG. 12 as being external to the RFID element 900. The antenna structure is tuned to receive a signal that is at an operating frequency of the EAS system (e.g., EAS system 100 of FIG. 1). For example, the operating frequency to which the antenna structure is tuned may be 13 MHz.

The control circuit 1208 controls the overall operation of the RFID element 900. Connected between the antenna structure and the control circuit 1208 is a receiver 1212. The receiver 1212 captures data signals carried by a carrier signal to which the antenna structure is tuned. In some scenarios, the data signals are generated by on/off keying the carrier signal. The receiver 1212 detects and captures the on/off keyed data signal.

Also connected between the antenna structure and the control circuit 1208 is the transmitter 1206. The transmitter 1206 operates to transmit a data signal via the antenna structure. In some scenarios, the transmitter 1206 selectively opens or shorts at least one reactive element (e.g., reflectors and/or delay elements) in the antenna structure 602 to provide perturbations in an RFID interrogation signal, such as a specific complex delay pattern and attenuation characteristics. The perturbations in the interrogation signal are detectable by an RFID reader (e.g., the detection equipment 114 of FIG. 1).

The control circuit 1208 may store various information in memory 1210. Accordingly, the memory 1210 is connected to and accessible by the control circuit 1208 through electrical connection 1220. The memory 1210 may be a volatile memory and/or a non-volatile memory. For example, memory 1212 can include, but is not limited to, a Radon Access Memory ("RAM"), a Dynamic RAM ("DRAM"), a Read Only Memory ("ROM") and a flash memory. The memory 1210 may also comprise unsecure memory and/or secure memory. The memory 1210 can be used to store identification data which may be transmitted from the RFID element 900 via an identification signal. The memory 1210 may also store other information received by receiver 1212. The other information can include, but is not limited to, information indicative of the handling or sale of an article.

The power store 1204 is connected to the antenna structure and accumulates power from a signal induced in the antenna structure as a result of the reception of the RFID interrogation signal by the RFID element 900. The power store 1204 is configured to supply power to the transmitter 1206, control circuit 1208, and receiver 1212. The power store 1204 may include, but is not limited to, a storage capacitor.

Figure 13:
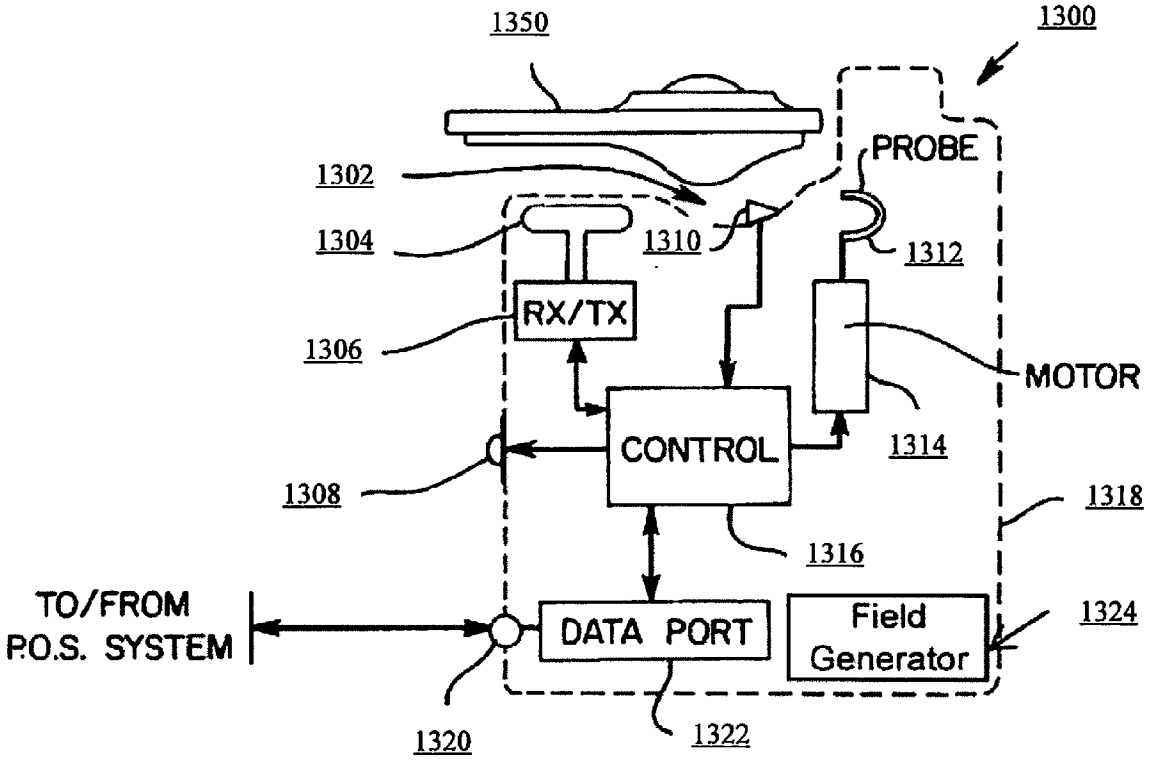
FIG. 13 is a schematic illustration of an EAS security tag and a detaching unit that is useful for understanding the present invention.
Figure 14:
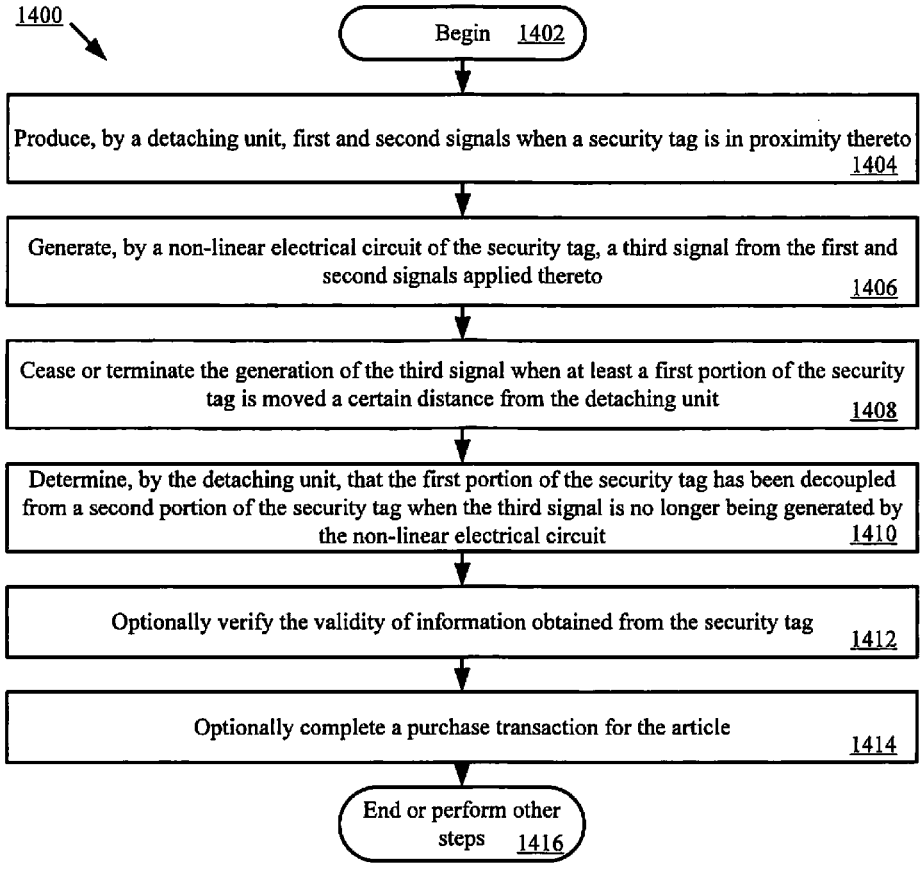
FIG. 14 is a flow diagram of an exemplary method for verifying a detachment of an EAS security tag from a given article that is useful for understanding the present invention.

Referring now to FIG. 13, there is provided a schematic illustration of an exemplary architecture for a detaching unit 1300 that is useful for understanding the present invention. The detaching unit 106 of FIG. 1 can be the same as or similar to detaching unit 1300. As such, the following discussion of detaching unit 1300 is sufficient for understanding the detaching unit 106 of FIG. 1.

As shown in FIG. 13, the detaching unit 1300 includes a housing 1318 in which a plurality of components is housed. At a top surface of the housing 1318, there is provided a nesting area 1302. The nesting area 1302 is sized and shaped to receive at least a portion of an EAS security tag 1350. EAS security tag 1350 can be the same as or similar to EAS security tag 108 of FIGS. 1-2. A mechanically actuatable switch 1310 is mounted in the nesting area 1302 to provide an indication that the EAS security tag 1350 has been positioned in the nesting area 1302, and/or is in proximity to the detaching unit 1300. Although only one switch 1310 is shown in FIG. 13, the present invention is not limited in this regard. Any number of switches can be provided in accordance with a particular application.

Notably, the detaching unit 1300 comprises a field generator 1324. The field generator 1324 is configured to generate an RF field and an electrostatic field to which a verification element (e.g., verification element 350 of FIG. 3 or 750 of FIG. 7) of the EAS security tag 1350 can respond. These fields can be continuously produced by the field generator 1324, or only when the security tag is in proximity to the detaching unit. In the later scenario, the detaching unit may comprise one or more proximity sensors (e.g., switch 1310) to detect when a security tag is in proximity thereto. The proximity sensors can include, but are not limited, to RFID enabled devices and/or depressible switches (e.g., switch 1310). In response to such detection, the detaching unit generates the RF field and electrostatic field.

The verification element of the EAS security tag 1350 comprises a mixing element (e.g., mixing element 504 of FIG. 5). The mixing element is generally provided for allowing a determination to be made by the detaching unit 1300 as to whether or not a pin (e.g., pin 306 of FIG. 3) has been removed from a housing (e.g., housing 318 of FIG. 3) of the EAS security tag 1350. Accordingly, the mixing element comprises a non-linear element. During operation, the mixing element responds to the RF field and the electrostatic field generated by the detaching unit 1300. More specifically, the mixing element generates at least one response signal from mixing the RF signal and the electrostatic signal applied thereto. Reception of the response signal by the detaching unit 1300 indicates that a pin is still coupled to a housing of an EAS security tag 1350 (or stated differently, that both the housing and pin of the EAS security tag 1350 are still present within the nesting area 1302).

During a detaching process, the EAS security tag 1350 is detached from the article by the decoupling of the pin from the housing thereof. The detaching process is typically performed as part of an article purchase process. The detaching process involves driving a motor 1314 so as to cause a probe 1312 to be inserted into the EAS security tag 1350. As a consequence of this insertion, the clamping mechanism 1316 of the EAS security tag 1350 is released, whereby the pin can be separated from the housing thereof.

When the pin is separated from housing and removed a certain distance from the detaching unit 1300, the mixing element ceases generating the response signal, thereby indicating that the pin has actually been decoupled from housing of the EAS security tag 1350 and verifying the customer's intent to purchase the article. Once the response signal goes away, the purchase of the article can be verified. In response to this verification, the RFID reader communicates RFID data to a POS terminal 102 so that the purchase transaction can be completed.

Referring now to FIG. 8, there is provided an exemplary method 1400 for verifying a detachment of a security tag from an article. The method 1400 begins with step 1402 and continues with step 1404. In step 1404, a detaching unit (e.g., detaching unit 106 of FIG. 1) produces first and second signals at least when the security tag (e.g., security tag 108 of FIG. 1) is in proximity thereto. The first signal has a first frequency (e.g., 900 MHz) and the second signal has a second frequency (e.g., 100 kHz) different from the first frequency. In some scenarios, the first signal is an RF signal and the second signal is an electrostatic signal.

Next in step 1406, a non-linear electrical circuit (e.g., mixing element 504 of FIG. 5) of the security tag generates a third signal from the first and second signals applied thereto. In some scenarios, the non-linear electrical circuit includes, but is not limited to, a diode or a capacitor placed across two dipole antenna elements (e.g., antenna elements 506 and 508 of FIG. 5) and/or a resonating capacitor (e.g., capacitor 610 of FIG. 6) of an antenna structure.

As shown by step 1408, the generation of the third signal is ceased or terminated when at least a first portion of the security tag is moved a certain distance from the detaching unit. For example, if the non-linear electrical circuit is disposed in a pin head (e.g., pin head 308 of FIG. 3) of the security tag, then it would stop generating the third signal when the pin (e.g., pin 306 of FIG. 3) is removed from the tag body (e.g., tag body 318 of FIG. 3) and placed a certain distance from the tag body (which may still be in proximity to the detaching unit). When the third signal is no longer being generated by the non-linear electrical circuit, the detaching unit makes a determination that the first portion of the security tag has been decoupled from a second portion of the security tag, as shown by step 1410.

Prior to or subsequent to such a determination by the detaching unit, the validity of information obtained from the security tag is verified, as shown by optional step 1412. For example, a unique identifier for the security tag is compared to a list of identifiers to determine if a match exists therebetween. The unique identifier can be obtained by the detaching unit via RFID communications with an RFID element of the security tag.

A purchase transaction of the article may be completed when the validity of the information has been verified, as shown by optional step 1414. In some cases, the purchase transaction is not completed until the above described determination has also been made by the detaching unit (i.e., the determination that the first portion of the security tag has been decoupled from the second portion of the security tag).

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A method for verifying a detachment of a security tag from an article, comprising:

concurrently producing, by a detaching unit, a first signal at a first frequency and a second signal at a second frequency when the security tag is in proximity to the detaching unit, the detaching unit operative to detach the security tag from the article;

performing operations by a non-linear frequency mixer circuit disposed within the security tag to generate a third signal from mixing the first and second signals applied thereto by the detaching unit, where the non-linear frequency mixer is exclusive of an Electronic Article Surveillance ("EAS") element disposed within the security tag;

ceasing generation of the third signal by the non-linear frequency mixer circuit when a first portion of the security tag is moved a certain distance from the detaching unit; and determining by the detaching unit that the first portion of the security tag has been decoupled from a second portion of the security tag when the third signal is no longer being generated by the non-linear frequency mixer circuit.

2. The method according to claim 1, wherein the first frequency falls within an Ultra-high frequency band and the second frequency falls within a low frequency band.

3. The method according to claim 1, wherein the first portion of the security tag comprises a pin or the second portion of the security tag comprises a tag body.

4. The method according to claim 1, wherein the second portion of the security tag is still in proximity to the detaching unit when generation of the third signal is ceased.

5. The method according to claim 1, wherein the non-linear frequency mixer circuit comprises a diode or a capacitor placed across two dipole antenna elements.

6. The method according to claim 1, wherein the non-linear frequency mixer circuit comprises a diode or capacitor arranged in parallel with a resonating capacitor of an antenna structure.

7. The method according to claim 1, further comprising verifying a validity of information obtained from the security tag prior to or subsequent to a determination that the first portion of the security tag has been decoupled from the second portion of the security tag.

8. The method according to claim 7, wherein the information comprises a unique identifier for the security tag which was obtained by the detaching unit via RFID communications with an RFID element of the security tag.

9. The method according to claim 7, further comprising completing a purchase transaction of the article when (1) a determination has been made that the first portion of the security tag has been decoupled from the second portion of the security tag, and (2) the validity of the information has been verified.

10. The method according to claim 1, further comprising detecting by the detaching unit when the security tag is in proximity thereto.

11. The method according to claim 10, wherein the first and second signals are generated in response to the detection that the security tag is in proximity to the detaching unit.

12. A system, comprising:

a security tag comprising a non-linear frequency mixer circuit generating a third signal from mixing first and second signals applied thereto by a detaching unit, the first signal having a first frequency and the second signal having a second frequency different from the first frequency; and said detaching unit determining that a first portion of the security tag has been decoupled from a second portion of the security tag when the third signal is no longer being generated by the non-linear electrical circuit;

wherein the third signal is no longer generated by the non-linear electrical circuit when the first portion of the security tag is moved a certain distance from the detaching unit; and wherein the non-linear frequency mixer circuit is exclusive of an Electronic Article Surveillance ("EAS") element disposed within the security tag.

13. The system according to claim 12, wherein the first frequency falls within an Ultra-high frequency band and the second frequency falls within a low frequency band.

14. The system according to claim 12, wherein the first portion of the security tag comprises a pin or a tag body.

15. The system according to claim 12, wherein the non-linear frequency mixer circuit comprises a diode or a capacitor placed across two dipole antenna elements.

16. The system according to claim 12, wherein the non-linear frequency mixer circuit comprises a diode or capacitor arranged in parallel with a resonating capacitor of an antenna structure.

17. The system according to claim 12, wherein the detaching unit further performs operations to verify a validity of information obtained from the security tag prior to or subsequent to a determination that the first portion of the security tag has been decoupled from the second portion of the security tag.

18. The system according to claim 17, wherein the information comprises a unique identifier for the security tag which was obtained by the detaching unit via RFID communications with an RFID element of the security tag.

19. The system according to claim 16, wherein a purchase transaction of an article is completed when (1) a determination has been made that the first portion of the security tag has been decoupled from the second portion of the security tag, and (2) the validity of the information has been verified.

20. The system according to claim 12, wherein the first and second signals are applied to the security tag in response to a detection by the detaching unit that the security tag is in proximity thereto.

* * * * *